US005184770A

United States Patent [19]

Cote

[11] Patent Number: 5,184,770

[45] Date of Patent: Feb. 9, 1993

[54] SLIDE TOP DISPENSING CARTON AND BLANK THEREFOR

[75] Inventor: Raymond A. Cote, Taylorsville, N.C.

[73] Assignee: Waldorf Corporation, St. Paul, Minn.

[21] Appl. No.: 816,680

[22] Filed: Jan. 3, 1992

[51] Int. Cl.[5] ..... B65D 43/20

[52] U.S. Cl. ..... 229/20; 229/125.12; 229/220

[58] Field of Search ..... 229/9, 11, 19, 20, 125.12, 229/220; 206/621.8

[56] References Cited

U.S. PATENT DOCUMENTS

| | | | |
|---|---|---|---|
| 1,998,862 | 4/1935 | Caruso et al. | 229/220 |
| 2,349,748 | 5/1944 | Otto | 229/220 |
| 2,902,201 | 9/1959 | Engblom | 229/125.12 |
| 2,975,952 | 3/1961 | Tamarin | 229/220 |
| 3,021,992 | 2/1962 | Phillips, Jr. | 229/125.12 |
| 3,229,888 | 1/1966 | Gillam | 229/220 |
| 3,819,093 | 6/1974 | Forbes, Jr. | 229/220 |
| 4,094,456 | 6/1978 | Roccaforte | 229/125.12 |
| 4,138,016 | 2/1979 | Roccaforte | 229/125.12 |
| 4,201,329 | 5/1980 | Roccaforte | 229/125.12 |
| 4,609,142 | 9/1986 | Adamek | 229/220 |

FOREIGN PATENT DOCUMENTS

| | | | |
|---|---|---|---|
| 921524 | 3/1963 | United Kingdom | 206/621.8 |

*Primary Examiner*—Gary E. Elkins
*Attorney, Agent, or Firm*—Dorsey & Whitney

[57] ABSTRACT

An improved reclosable slide top dispensing carton is provided. The top dispensing end of the carton includes a top support panel including an aperture through which the contents can be dispensed. A movable slide panel overlies the top support panel to enable the selective opening and closing of the aperture. Opening and closing is facilitated and controlled by an integral tab extension and a slide top. Inner and outer top closure flaps are secured over the slide panel.

The invention encompasses a blank for forming the carton. The blank uses a minimum of paperboard material, yet provides a properly supported dispensing end that is durable and can easily and repeatedly be opened and closed.

14 Claims, 4 Drawing Sheets

Fig.11
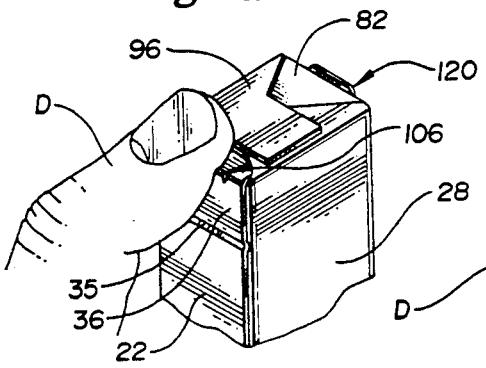
Fig.12
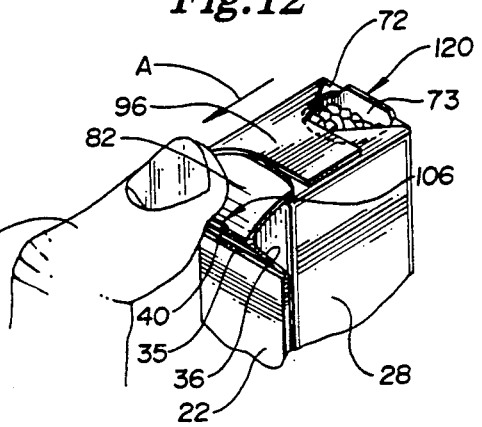
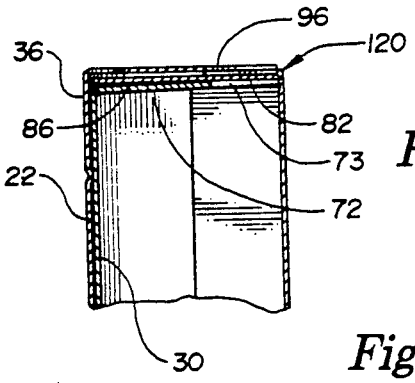
Fig.13
Fig.14
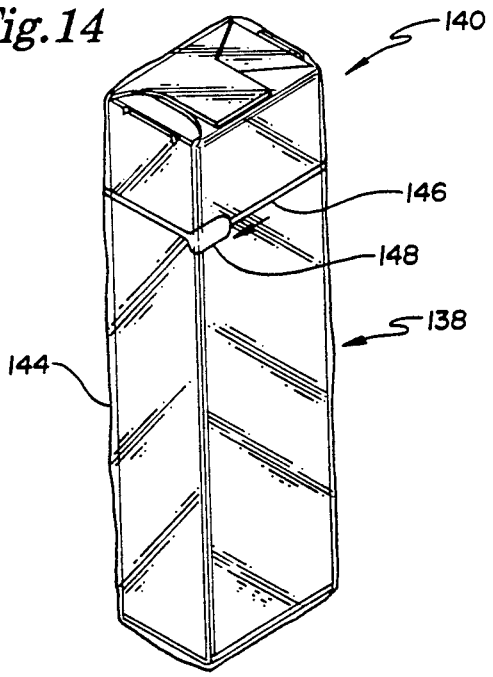

SLIDE TOP DISPENSING CARTON AND BLANK THEREFOR

BACKGROUND OF THE INVENTION

Reclosable dispensing cartons have become increasingly popular for storing and dispensing products that are generally particulate in nature and not likely to be used completely immediately after their initial opening. Food items such as small candies, gum or nuts fall into this category of products in that they may be packaged as a plurality of small discrete pieces and they are generally flowable in nature. Additionally, only a few of such items generally are used or consumed at one time, with the remainder being stored and kept sanitary for subsequent use. Other products that are well suited for packaging in reclosable slide top dispensing cartons include other food products such as cough drops or powdered material, or granular detergents.

Reclosable slide top dispensing cartons should insure proper and easy repeatable operation. The construction of the carton must insure that the reclosable portion of the carton is not locked or fastened in its closed condition during the manufacturing process. The reclosable slide panel should not be able to move into a position that would make repeated opening and closing difficult. Additionally, the carton, particularly if intended to contain food items, must insure that the contents are kept as sanitary as possible during periods of storage, yet are conveniently and easily accessible.

It is desirable that slide top dispensing cartons use a minimum of paperboard material to keep manufacturing costs as low as possible and that such cartons are easy to erect, fill and glue.

Two known reclosable dispensing cartons are disclosed in U.S. Pat. Nos. 4,094,456 and 4,138,016 (both to Roccaforte), assigned to the assignee of subject invention. U.S. Pat. No. 4,094,456 includes a closure flap articulated to a side wall of the carton and slidably disposed between two apertured tabs. The closure flap can be slid relative to the registered apertures to either block or provide access to the interior of the carton. However, the innermost apertured flap could fall inwardly, adversely affecting the repeated operation of the slidable closure flap. Additionally, the carton includes a glue flap articulated to the outermost apertured flap, requiring an excess of paperboard material.

U.S. Pat. No. 4,138,016 discloses a carton directed to eliminating the glue flap described above and to providing support to prevent the top closure panels from falling inwardly. The carton includes first through third top flaps having registered apertures. The second apertured top flap is articulated to the second sidewall of the carton and the sliding closure flap is disclosed in face-to-face contact with the second apertured top flap. The carton top is formed by rotating the second apertured top flap and the sliding closure flap inwardly in advance of the first and third top flaps. The sliding closure flap may be slid intermediate the respective apertured top flaps. The innermost top flap prevents the sliding closure flap and the first and third apertured top flaps from falling inwardly relative to the carton.

U.S. Pat. No. 3,819,093 (to Forbes, Jr.) discloses a slide top dispensing carton having a captured slide panel for covering and uncovering a dispensing opening in a completely sift proof closure for the top of the carton. However, as in U.S. Pat. No. 4,094,456, a glue flap is required to seal the carton. Further, it is necessary to remove a portion of the top of the carton, by tearing through at least one layer of paperboard and separating adhesives, to open the carton.

Somewhat similarly, U.S. Pat. No. 4,609,142 (to Adamek), assigned to assignee of the subject invention, is directed to improving the cartons disclosed in U.S. Pat. Nos. 4,094,456 and 4,138,016 and discloses a reclosable dispensing carton and blank therefor. The disclosed carton and blank are directed to using a minimum amount of paperboard material, yet achieving a properly supported top that can easily and repeatedly be opened and closed. The carton includes pairs of alignment embossments and debossments and an outer top closure panel including an array of perforations that enable removal of a portion of the outer top closure panel. Thus, it is necessary to tear through at least one layer of paperboard to gain access to the slide that opens and closes the carton.

Despite the progressive improvement in reclosable dispensing cartons represented by the above noted patents, it is desirable to provide a carton that uses even less paperboard material, and that is even more certain of providing easy, proper initial operation of a sliding closure flap and easy, proper long-term operation thereof.

With current reclosable slide top dispensing cartons, it is clear that efficient use of paperboard, cost efficient production, ease of use and durability are not optimized. Accordingly, there is a need for a strong, durable, easily used reclosable paperboard carton for containing and dispensing food items such as small candies, gum or nuts.

SUMMARY OF THE INVENTION

In accordance with the present invention, a carton for containing and dispensing small discrete items, such as small pieces of gum, is provided. The carton is a tubular carton having an outer first side wall panel, a rear wall panel, a second side wall panel, a front wall panel, an inner first side panel and rear flap consecutively articulated to one another along parallel fold lines. The rear wall panel and the front wall panel are substantially identical. The inner and outer first side wall panels and the second wall panel are substantially the same size and shape, although the inner side wall panel is somewhat less in length than the outer side wall panel, with reference to the distance from the top of the carton to the bottom. More specifically, the inner first side wall panel is somewhat shorter than the outer first side wall panel, having a relieved area at the top.

The outer first side wall panel includes a hinge line extending orthogonally to the articulation between the outer first side panel and the rear panel. The hinge line in the outer first side wall panel divides the wall panel into a base portion and an upper hinge portion.

The inner side wall panel is adhesively connected to the inside of the outer first side wall panel, whereby the two panels are parallel face-to-face contact. The hinge portion of the outer side wall panel is free of adhesive, and not connected to the inner side wall panel.

Generally rectangular bottom closure flaps are articulated to the outer first side wall panel, the rear wall panel, the second side wall panel, and the front wall panel respectively along fold lines that are generally collinear with one another. The bottom flaps are sized to be folded into overlapping relationship to provide complete closure of the bottom of the carton.

With regard to the top dispensing end of the carton, a generally rectangular top support panel is articulated to the second side wall panel along a fold line extending generally parallel to the foldable connection between the second side wall panel and its associated bottom flap. The top support panel includes a cut-out aperture appropriately dimensioned and shaped to enable easy dispensing of the material contained in the carton. An integral slide stop is adjacent the aperture and the hinged connection between the top support panel and the second side wall panel. The top support panel is the first inwardly folded panel at the top of the carton, and in conjunction with the inner first side wall panel, prevents the other closure panels at the top of the carton from being folded or forced inwardly into the carton interior.

Inner and outer top closure flaps are articulated to the rear and front wall panels respectively along fold lines that are collinear with the foldable connection between the top support panel and the second side wall panel. The inner and outer top closure flaps are generally the same size and shape, each having a base area extending along the foldable connection between the flaps and the rear and front wall panels. More particularly, the inner and outer top closure flaps are generally rectangular, but preferably include substantially identical cut-out or relieved portions at the sides most closely adjacent and most distant from the connection between the top support panel and the second side wall panel (when the carton is completely erected). The relieved cut-out areas of the inner and outer top closure panel flaps form the closure flaps into a substantially rectangular tab, and one of the cut-out or relieved areas is located to lie in register with the cut-out aperture of the top support panel when the carton is erected.

A generally rectangular slide panel is foldably articulated to the hinged portion of the outer first side wall panel along a fold line that is generally collinear with the fold line between the inner top closure panel and the rear wall panel. An integral tab extension is at one edge of the slide panel adjacent the fold line. The extension is formed by a U-shaped cut, the ends of the cut being closely adjacent or extending into the fold line and the straight portion being parallel to the fold line. The slide panel extends sufficiently far from the outer first side wall panel to enable the slide panel to completely obstruct the cut-out aperture in the top support panel, to obstruct the cut-out areas in the inner and outer top closure flaps, and to contact the slide stop.

The blank described above is not provided with a sealing panel or flap adapted to overlie the front or rear panel as in the carton of U.S. Pat. No. 4,094,456. The blank described above is not provided with a top panel articulated to the inner first side panel as in the carton of U.S. Pat. No. 4,138,016. As a result, the blank and carton of this invention result in a more efficient use of paperboard material, yet provide a carton that enables easy, efficient repeated opening, while preventing the top panels from falling or being pushed inwardly into the carton interior.

The blank of the present invention is formed into an erected carton by consecutively folding the outer first side wall panel, the rear wall panel, the second side wall panel, the front wall panel, the inner first side wall panel and the rear wall panel about their respective fold lines. The inner first side wall panel is positioned to lie inwardly relative to the outer first side wall panel and the rear flap foldably connected to the inner first side wall panel is positioned to lie in close face-to-face contact with a portion of the rear wall panel. The inner first side wall panel and the base portion of the outer first side wall panels are adhered to one another, but the hinged portion of the outer first side wall panel is not adhered to the inner first side wall panel.

The bottom of the carton is formed by inwardly rotating the bottom closure flaps about their associated fold lines. The top of the carton is then closed by first rotating the top support panel inwardly to a position where it is substantially orthogonal to the various side wall panels of the carton. The slide panel is then rotated inwardly about its hinge connection to the outer first side wall panel to at least partially overlie the top support panel. In this folded condition, when the free end of the slide panel is adjacent the stop, the slide panel will completely obstruct the aperture of the top support panel, as well as the cut-out areas of the inner and outer top closure flaps. The inner and outer closure panels are consecutively folded inwardly over the slide panel and the outer top closure panel is adhered to the inner top closure panel.

When the carton is fully erected, the top support panel contacts and is supported by the inner first side wall panel and is prevented from falling or being forced inwardly into the carton interior. The inner and outer top closure flaps securely close the top of the carton, and the base area of the flaps guides the sliding panel between the flaps and the top support panel. The carton is designed to be overwrapped with an appropriate film, for example, a cellophane.

The carton can be opened easily by removing the overwrapping, freeing the slide panel for reciprocating movement between the inner and outer top closure flaps and the support panel. The opening in the top support panel can be either obstructed or unobstructed depending upon the position of the slide panel. When the hinged portion of the outer first side wall panel is in face-to-face contact with the inner first side wall panel, the slide panel will completely obstruct the aperture in the top support panel. An outward force exerted on the slide panel causes the hinge portion of the outer first side wall panel to rotate about its articulation to the base portion, and move angularly away from the inner first side wall panel. Thus, the slide panel selectively opens the top of the carton enabling the contents to be dispensed.

The carton can then be closed securely by exerting an appropriate, opposite force on the slide panel causing the hinged portion of the outer first side wall panel to rotate back into its face-to-face position relative to the inner first side wall panel and causing the slide panel to obstruct the aperture in the top support panel.

It is an object of the present invention to provide an improved slide top dispensing carton and a blank for forming the carton.

It is another object of the present invention to provide a reclosable slide top carton that uses less paperboard material than prior art cartons, yet is strong and durable.

Yet another object of the present invention is to provide an improved slide top carton that substantially prevents any of the top closure flaps and panels from falling or being forced inwardly into the carton.

It is a general object of the present invention to provide an improved slide top dispensing carton wherein repeated opening and closing of the carton is facilitated and controlled, thereby providing a reclosable carton that is easy to use and durable.

It is another object of the present invention to provide an improved slide top dispensing carton having a slide stop tab for controlling the extent of travel of the sliding panel and a finger receiving extension tab for assisting the operation of the sliding panel.

Other objects and advantages of the present invention will become more fully apparent and understood with reference to the following specification and to the appended drawings and claims.

BRIEF DESCRIPTION OF THE DRAWINGS

FIG. 11 is a perspective view of the carton of the present invention depicting a user's thumb positioned to open the carton for dispensing the contents.

FIG. 12 is a perspective view of the carton of the present invention opened to dispense some of the contents.

FIG. 13 is a cross-sectional view of the top end of the carton of the present invention taken along line 13—13 of FIG. 10.

FIG. 14 is a perspective view of the carton of the present invention with an overwrap in place, ready for vending or sale.

DETAILED DESCRIPTION OF THE PREFERRED EMBODIMENT

Figure 1:
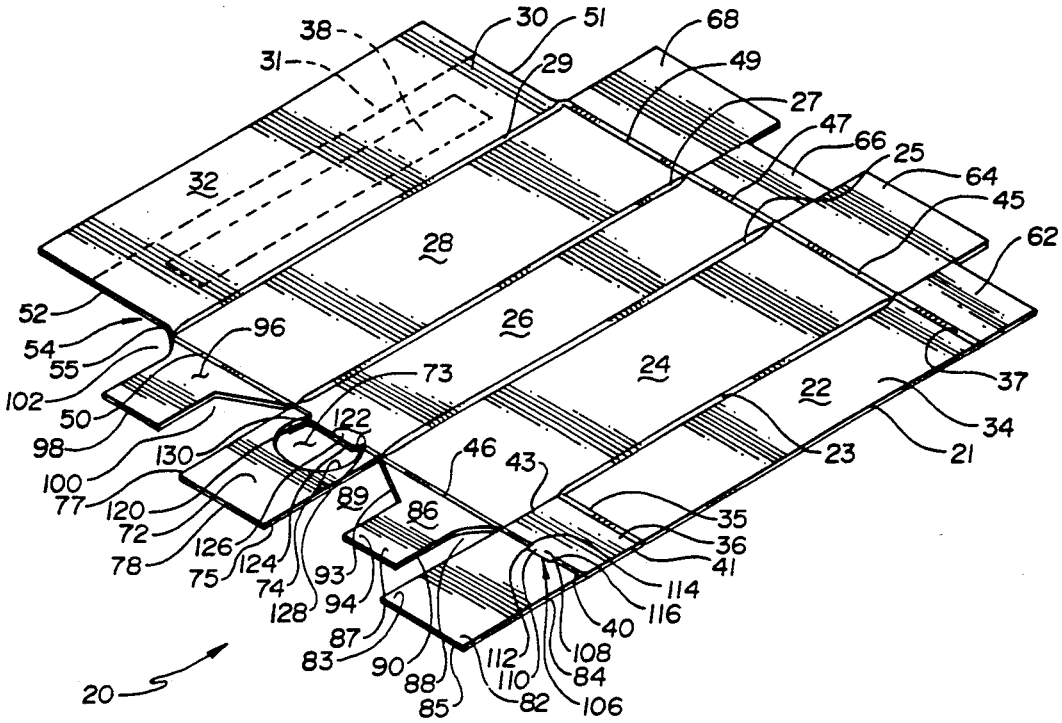
FIG. 1 is a perspective view of the blank from which the carton of the present invention is formed and depicts the die-cut profile thereof.
Figure 2:
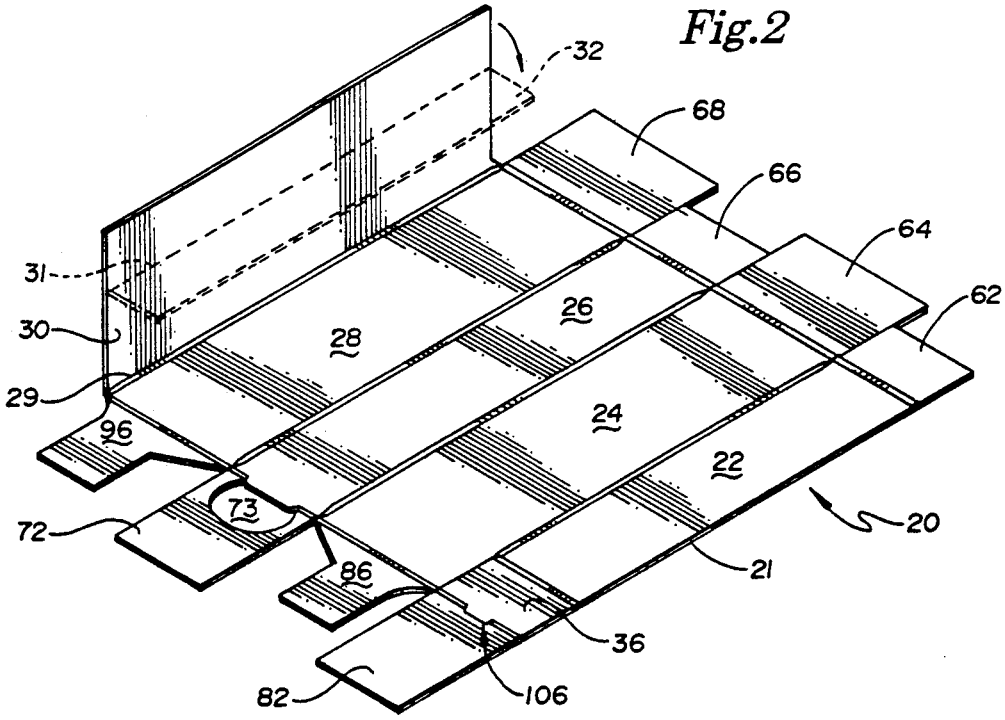
FIG. 2 is a perspective view of the blank depicting a first step in erecting the carton of the present invention.
Figure 3:
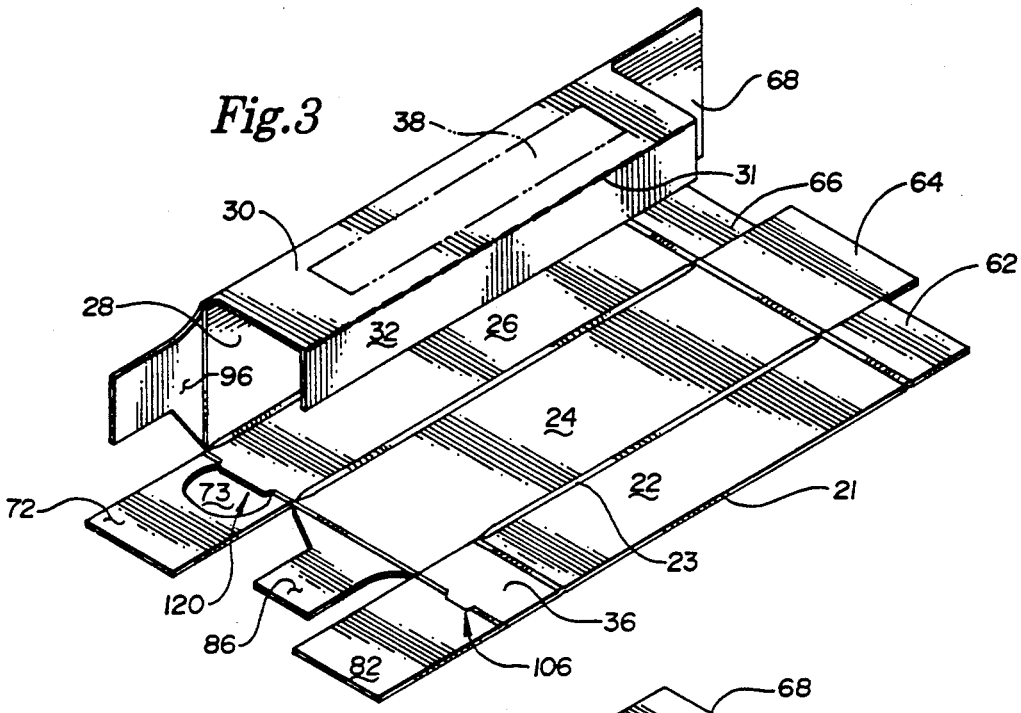
FIG. 3 is a perspective view of the blank showing a second, intermediate step in the erection of the carton.

The blank 20 of the present invention is depicted in FIG. 1. The blank 20 includes an outer first side panel 22, a rear panel 24, a second side panel 26, a front panel 28, an inner first side panel 30 and a rear flap 32. Each of the preceding panels or flaps are consecutively, foldably connected or articulated to one another along parallel fold lines 23, 25, 27, 29, 31. In the drawings, double lines indicate fold lines and single solid lines indicate cuts, scores, or free edges.

The outer first side panel 22 is further defined by edge 21 parallel to the fold line 23. The outer first side panel 22 includes a base portion 34 and a upper hinged portion 36 articulated or foldably connected to each other along a fold line 35. The fold line 35 is orthogonal to the fold line 23. The base portion 34 of the outer first side panel 22 is further defined by a fold line 37.

The upper, hinged portion 36 of the outer first side panel 22 is further defined by a fold line 40 parallel to and equal in length to the fold lines 35, 37. The hinge portion 36 includes an edge 41 extending collinearly from the edge 21 and is further defined by a cut line 43 extending collinearly from the fold line 23. The edge 41 and cut line 43 are substantially equal in length.

The rear panel 24 is further defined by a cut line 43 and by the fold lines 45, 46, which are equal in length and extend collinearly from the fold lines 37, 40, respectively.

The second side panel 26 is substantially the same size and shape as the outer first side panel 22. The second side panel 26 is further defined by the fold lines 47, 48 which are parallel to one another and extend collinearly from the fold lines 45, 46, respectively.

The front panel 28 is substantially identical to the rear panel 24, and is further defined by the fold lines 49, 50, extending collinearly from the fold lines 47, 48, respectively.

With continued reference to FIG. 1, the inner first side panel 30 is further defined by edges 51, 52 which extend generally collinearly from fold lines 49, 50, respectively. The inner first side panel 30 is substantially the same size and shape as the outer first side panel 22 and the second side panel 26, but is slightly less in length between the edges 51, 52. The inner first side panel 30 is shorter because it includes a relieved area 54, formed by a curved edge portion 55 adjacent the intersection of the fold lines 29, 50 and the edge 52. The remainder of the upper edge 52 of the inner first side panel 30 is parallel to the edge 51.

An adhesive strip or glue area 38 extends substantially from adjacent edge 51 to near edge 52, parallel to the fold line 29.

The blank 20 includes bottom closure flaps 62, 64, 66, 68 articulated or foldably connected respectively to the outer first side panel 22, rear panel 24, second side panel 26 and front panel 28 along the fold lines 37, 45, 47 and 49, respectively. The bottom closure flaps 62-68 are each generally rectangular and are sufficient in size to enable the complete closure of the bottom of the carton formed from the blank 10. One or more of the bottom closure flaps 62-68 is provided with an adhesive area, as is well-known in the art, to enable the complete, secure closure of the bottom of the carton.

A top support panel 72 is foldably connected to the second side panel 26 along the fold line 48. The top support panel 72 is generally rectangular and includes a generally round cut-out aperture 73 having a periphery 74. The cut-out aperture 73 is an appropriate size for pouring out the contents of the carton and, although it is substantially circular, a portion of the periphery 74, particularly where the periphery 74 is close to the fold line 48, may be straight. The aperture 73 is at least closely adjacent to the fold line 48 and a portion of the periphery 74 may be collinear with the fold line 48. The top support panel 72 is further formed by the cut edges 75, 77 extending collinearly from the fold lines 25, 27, respectively. The top support panel 72 is substantially the same width as the second side panel 26, and is substantially the same length as the width of the front and rear panels 28, 24, respectively. The top support panel 72 has a free edge 78 which is generally parallel to the fold line 48.

A slide panel 82 is foldably connected to the outer first side panel 22 along the fold line 40. The slide panel 82 is further defined by edges 83, 84 extending collinearly from the cut line 43 and the edge 41, respectively. The slide panel 82 is further defined by an edge 85 generally parallel to the fold line 40. The distance between the edge 85 and fold line 40, or the length of the slide panel 82, is sufficient to enable the slide panel 82 to completely obstruct the aperture 73.

An inner top closure flap 86 is foldably connected or articulated to the rear panel 24 along the fold line 46. The inner top closure flap 86 is tab-like, having a generally rectangular central portion 87, but includes two cut-out relieved areas 88, 89 to aid in the manipulation of the slide panel 82 and to reveal the aperture 73. The first cut-out relieved area 88 is formed along the cut edge 90 that includes a curved portion 91 and a portion 92 parallel to cut edge 83. The other cut-out relieved area 89 is formed by two intersecting, angularly related, straight cut edges 93, 94 and is at least sufficiently large enough to expose substantially all of the cutout aperture 73 in the top support panel 72.

An outer top closure flap 96 is foldably connected to the front panel 28 along the fold line 50. The outer top closure flap 96 is substantially identical to the inner top closure flap 86, including an edge 98 generally parallel to the fold line 50 and at least two cut-out relieved areas 100, 102 that are substantially the same as the cut-out relieved areas 89, 88, respectively, in the inner top closure flap 86.

With continued reference to FIG. 1, the blank 20 and, more specifically, the hinged portion 36 of the outer first side panel 22, includes a finger tab extension 106. The tab 106 has a tab base 108 and a finger contacting or receiving upstanding, free end 110. The tab 106 is formed by a generally U-shaped incision or cut 112 having two ends 114, 116 that are generally collinear with the fold line 40. The free end 110 of the tab 106 is formed by the straight portion of the cut 112, which is generally parallel and closely adjacent to the fold line 40.

The blank 20 and, more specifically, the second side panel 26, includes a slide stop tab 120. The tab 120 includes a stop tab base 122 and a free end 124. The tab 120 is formed by a generally U-shaped cut 126 having two ends 128, 130 generally collinear with the fold line 48. The free end 124 is formed at the straight portion of the cut 126, which is generally parallel and closely adjacent to the fold line 48.

Figure 4:
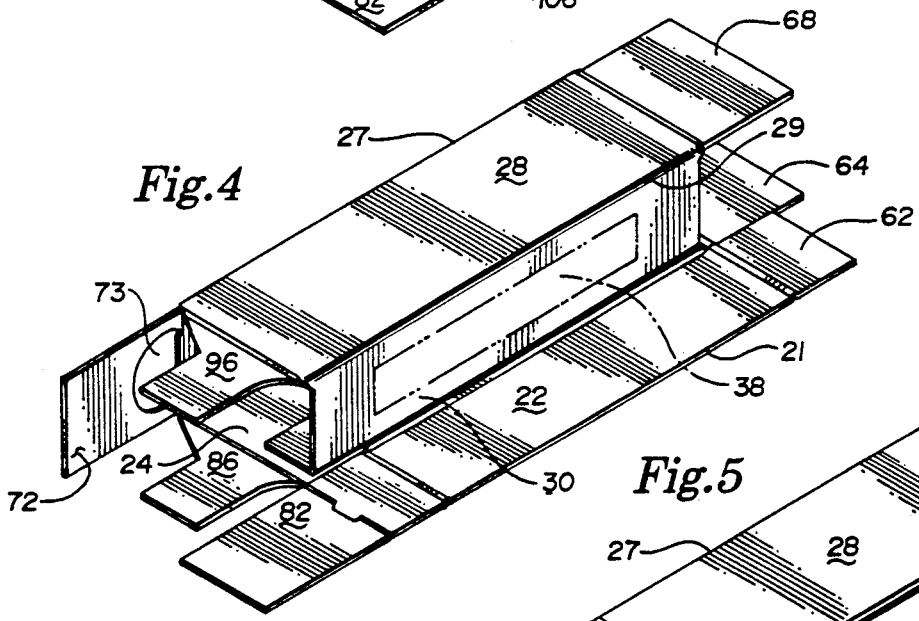
FIG. 4 is a perspective view of the blank showing another intermediate step in the erection of the carton.
Figure 5:
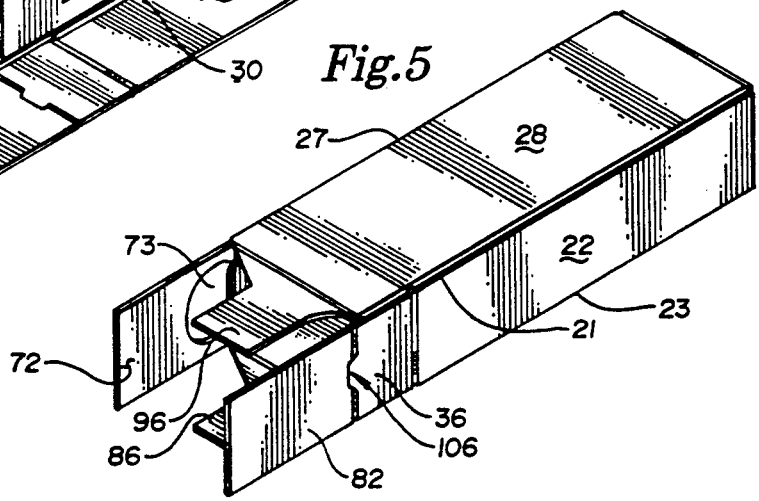
FIG. 5 is a perspective view of the blank of the present invention folded into a generally tubular carton, with the bottom closure flaps thereof closed.
Figure 6:
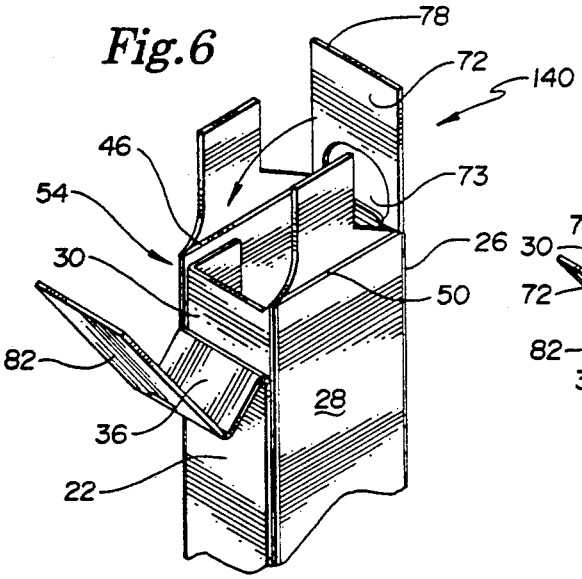
FIG. 6 is a perspective view of the top closure panels of the carton of the present invention and an initial step in the top closure sequence.

Referring to FIGS. 2–5, the blank 20 is erected into the carton 138 of the present invention by rotating the outer first side panel 22, the rear panel 24, second side panel 26, front panel 28, inner first side panel 30 and rear flap 32 about their respective fold line connections 23, 25, 27, 29 and 31. With reference to FIG. 4, the rear flap 32 is disposed inside and generally parallel to the rear panel 24. The inner first side panel 30 is adhesively connected inside the outer first side panel 22 at adhesive gluing area 38. The bottom flaps 62, 64, 66 and 68 are rotated about their respective fold lines 37, 45, 47 and 49 to form an overlaid bottom end closure for the carton, as depicted in FIG. 5.

Figure 7:
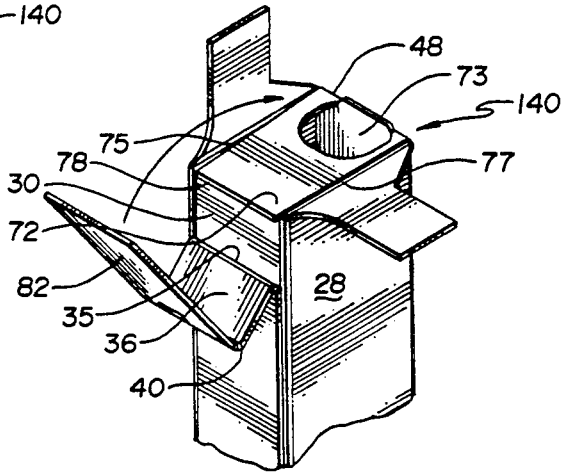
FIG. 7 is a perspective view showing an intermediate step in the closure sequence of the top of the carton.

With reference to FIGS. 6–9 the top dispensing end 140 of the carton 138 is formed by first rotating the top support panel 72 about fold line 48 into generally perpendicular alignment with the second side panel 26. As depicted in FIG. 7, the edges 75, 77 of the top support panel 72 are substantially adjacent the fold lines 46, 50, and the free edge 78 is substantially adjacent the relieved area 54 adjacent upper edge of the inner first side panel 30. As a result, the top support panel 72 is supported in a plane generally orthogonal to the side walls 22, 24, 26, 28 and 30 forming the outside of the carton 140.

Figure 8:
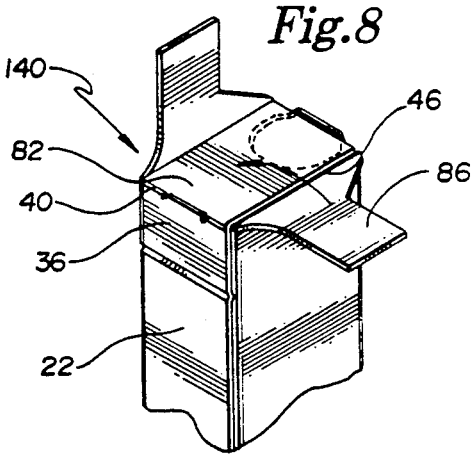
FIG. 8 is a perspective view of another intermediate step in the closure sequence of the top of the carton.

With reference to FIG. 7 and 8, the slide panel 82 may be rotated about the fold lines 35, 40 into overlapping relation with the top support panel 72 (depicted in FIG. 8). With reference to FIG. 8, the slide panel 82 completely overlies the aperture 73 in the top support panel 72, thereby completely covering and obstructing the aperture 73.

Figure 9:
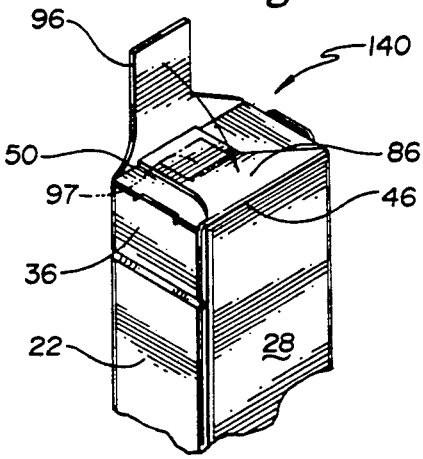
FIG. 9 is a perspective view showing another intermediate step in the closure sequence for closing the top of the carton.

With reference to FIG. 8 and 9, the top end 140 of the carton 138 is secured by first rotating the inner top closure flap 86 about fold line 46 to cover the slide panel 82. Next, the outer top closure panel 96 is rotated about fold line 50, and adhesive is applied to an adhesive area 97 to secure the outer top closure panel 90 to the inner top closure panel 86.

Figure 10:
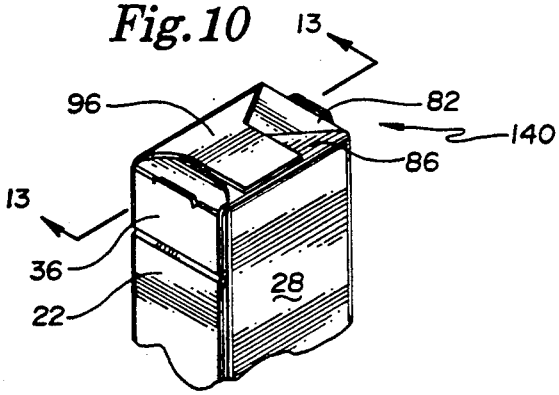
FIG. 10 is a perspective view of the dispensing top carton of the present invention completely closed.

With reference to FIGS. 10 and 13, in its closed condition the top dispensing end 140 of the carton 138 is effectively sealed shut, more specifically, the slide panel 82 completely covers the aperture 73 in the top support panel 72 and obstructs the relieved areas 88, 89, 100, 102 of the inner and outer top closure flaps 86, 96. Also, when the top end 140 is closed, the slide stop tab 120 and the finger tab extension 106 are upstanding and perpendicular relative to the top end 140 of the carton 138 and are generally parallel relative to each other. With reference to FIG. 14, the carton may be wrapped with an overwrap 144, a cellophane, for example, having an easy open tear strip 146 with a finger tab 148. In this condition the carton is ready for purchase.

With reference to FIGS. 11 and 12, the use of the carton 138 is depicted. Initial access to the contents in the carton 138 is achieved by first removing the overwrap 144. After removing the overwrap 144, the carton 138 can be opened by slidably moving the slide panel 82 by manipulating the tab extension 106 with a finger or thumb D, as depicted in FIG. 11. An outward force in the direction of arrow A in FIG. 12 causes a rotational movement of the hinged portion 36 of the outer first side panel 22 about the fold line 35. Sufficient movement of the slide panel 82 in this manner effectively eliminates the obstruction of the aperture 73 in the top support panel 72. The contents, or a portion thereof, can be dispensed by inverting or partially inverting the carton 138. The carton 138 can then be closed by exerting an opposite force on the slide panel 82 through the hinged portion 36 of the outer first side panel 22. The stop tab 120 will prevent the slide panel 82 from extending too far over the top end 140 of the carton 138.

In summary, an improved reclosable slide-top dispensing carton 138 and a blank 20 for forming the carton 138 are provided. The blank 20 uses less paperboard material than prior art structures of this type. Additionally, the carton 138 is constructed to substantially prevent the slide panel 82 from falling or being forced inwardly into the carton 138 and to insure unimpeded easy movement of the slide panel 82. The carton 138 can be repeatedly opened and closed by appropriate sliding movements of the sliding panel 82.

A number of variations of the present invention can be made. For example, the carton 138 may be made in various sizes and the aperture 73 in the top end 140 of the carton 138 may be made in various sizes to correspond with various intended contents. The paperboard from which the present invention is made may be of any suitable composition and may be coated with the appropriate substances to impart desirable characteristics such as resistance to moisture. The carton 138 may be filled from the top or bottom end, and various methods might be used to hold the carton ends in the closed positions depicted in FIG. 14. Such methods might include the use of appropriate adhesives or activatable adhesive areas, or systems of interlocking tabs. The generally rectangular cross-section of the carton 138 is convenient, but other cross-sectional configurations could be used. Although a cellophane is depicted in FIG. 14 as overwrapping the carton 138, any appropriate thermoplastic sheet material or other suitable material might be used. Both the interior and exterior of the carton 138 or the blank 20 may be marked with appropriate indicia.

Although a description of the preferred embodiment has been presented, it is contemplated that various changes, including those mentioned above, could be made without deviating from the spirit of the present invention. It is therefore desired that the present embodiment be considered in all respects as illustrative, not restrictive, and that reference be made to the appended claims rather than to the foregoing description to indicate the scope of the invention.

What is claimed is:

1. A slide top dispensing carton comprising:

opposed generally rectangular front and rear walls disposed in spaced parallel relationship;

first and second opposed side walls disposed in spaced parallel relationship and extending between and connecting the front and rear walls, the first side wall including inner and outer panels in contacting relationship, the outer panel of the first side wall including a base portion adhered to the inner panel and a hinged portion rotatable about the base portion toward and away from the inner panel;

a bottom end closure comprising a plurality of bottom flaps, at least one foldably connected to each of the front wall, rear wall, first side wall and second side wall; and a top wall having multiple layers and comprising a top support panel foldably connected to the second side wall at a fold line and defining the innermost layer of the top wall, the top support panel extending substantially the entire distance between the front and rear walls and the entire distance between the first and second side walls of said carton, whereby said inner panel of the first side wall supports the top support panel in a plane generally orthogonal to the front, rear, first side and second side walls of the carton, the top support panel including an aperture extending therethrough, the aperture adjacent the fold line between the top support panel and the second side wall, a slide panel foldably connected to the hinged portion of the outer panel of the first side wall, the slide panel being disposed in contact with the top support panel, and an inner and an outer top closure flap foldably connected respectively to the rear and front panel and folded over the slide panel, the inner and outer top closure flaps being substantially identical and including at least one relieved area in register with the aperture in the top support panel, whereby rotation of the hinged portion of the first side wall moves the slide panel between the top support panel and the inner top closure flap and relative to the aperture in the top support panel.

2. The carton according to claim 1, wherein said hinged portion of the first side wall includes a rotation assisting means for assisting the rotation of the hinged portion, said rotation assisting means being adjacent the fold line at the foldable connection between the slide panel and hinged portion.

3. The carton according to claim 2, wherein said rotation assisting means comprises an extension continuous with and extending generally upwardly from the hinged portion of the outer panel of the first side wall, said extension having a free upper edge lying in a plane generally parallel to the plane of the slide panel and an extension base closely adjacent to the fold line at the foldable connection between the slide panel and hinged portion.

4. The carton according to claim 1, wherein the second side wall includes a slide stop means for controlling the extent of movement of the slide panel, said slide stop means being adjacent the fold line at the foldable connection between the top support panel and the second side wall.

5. The carton according to claim 4, wherein said slide stop means comprises a stop tab continuous with and extending generally upwardly from the second side wall, said stop tab having a free upper edge lying in a plane generally parallel to the plane of the top support panel and a base closely adjacent to the fold line at the foldable connection between the top support panel and second side wall.

6. The carton according to claim 5, wherein the inner panel of the first side wall includes a relieved area adjacent the hinged portion of the outer panel of the first side wall.

7. The carton according to claim 1, wherein at least a portion of each of the inner and outer top closure flaps extends substantially entirely between said front and rear walls, and each flap includes a first relieved area adjacent the first side wall and a second relieved area adjacent the second side wall, said first relieved area being dimensioned to permit substantially full exposure of the aperture in the top support panel.

8. The carton according to claim 7, said aperture having a periphery, at least a portion of said periphery being collinear with said fold line foldably connecting the top support panel to the second side wall.

9. A blank for forming a reclosable slide top dispensing carton, said blank comprising:

an outer first side panel, a rear panel, a second side panel, a front panel and an inner first side panel, each of the aforesaid panels being generally rectangular and consecutively connected to one another along parallel fold lines, said front and rear panels being substantially identical, said second side panel including a stop tab, said outer first side panel including a base portion foldably connected to said rear panel and a hinged portion foldably connected to said base portion along a fold line extending generally perpendicularly to the fold line between said outer first side panel and said rear panel, said hinged portion being separated from said rear panel by a cut line extending collinearly from the fold line between said outer first side panel and said rear panel;

bottom closure flaps foldably connected respectively to each of said outer first side panel, rear panel, second side panel and front panel;

a top support panel foldably connected to said second side panel along a fold line extending generally perpendicular to the fold line between said second side panel and said front and rear panels, said top support panel including an aperture, said aperture adjacent said fold line along which said top support panel is foldably connected to said second side panel, said top support panel having a length substantially the same as the width of the front and rear panels, whereby in the carton formed from the blank said top support panel contacts said inner first side panel, said inner first side panel supporting said top support panel in a plane generally orthogonal to the first and second side walls of the carton;

a slide panel foldably connected to the hinged portion of said outer first side panel along a fold line extending generally perpendicular to the cut line between said hinged portion and said rear panel, said slide panel including a cut adjacent to said fold line that extends generally perpendicular to the cut line, said cut defining a tab extension of said hinged portion; and inner and outer top closure flaps foldably connected to said front and rear panels along fold lines extending collinearly from the foldable connection between said top support panel and said second side panel, said inner and outer top closure flaps including a generally central portion extending substantially across the distance between said front and rear panels and first and second relieved areas, one of said relieved areas being at least sufficiently large enough to substantially expose said aperture in said top support panel.

10. The blank according to claim 9, wherein said top support panel includes a generally U-shaped cut having two ends and a generally straight base line portion between said two ends, said cut being closely adjacent to the fold line at which the top support panel is articulated to the second side, the two ends being generally collinear with said fold line and the base line portion being generally parallel to said fold line.

11. The blank according to claim 10, wherein said generally U-shaped cut comprises a portion of the periphery of said aperture in said top support panel.

12. The blank according to claim 9, wherein said slide panel includes a generally U-shaped cut having two ends and a generally straight base line portion between said two ends, said cut being closely adjacent to the fold line at which the slide panel is foldably connected to the hinged portion of the outer first side panel, the two ends being generally collinear with said fold line and the base line portion being generally parallel to said fold line.

13. A slide top dispensing carton comprising:

a carton structure having first and second opposed side walls, the first side wall including a hinged portion, and opposed front and rear walls each comprising at least one wall panel, said front and rear walls extending between and connecting said first and second side walls;

a multi-layer top wall comprising a top support panel foldably connected to the second side wall at a fold line and defining the innermost layer of the top wall, the top support panel including an aperture extending therethrough, the aperture adjacent the fold line between the top support panel and the second side wall, a sliding slide panel foldably connected to the hinged portion of the first side wall, the slide panel being disposed in contact with the top support panel, a stop means for limiting the sliding movement of said slide panel, the stop means being adjacent the fold line between the top support panel and the second side wall, and top closure flap means including at least one closure flap foldably connected to at least one of the rear and front walls and folded over the slide panel for retaining the slide panel in sliding relationship relative to said top support panel, whereby rotation of the hinged portion of the first side wall moves the slide panel between the top support panel and the inner top closure flap and relative to the aperture in the top support panel, and wherein said hinged portion includes a rotation assisting means for assisting the rotation of the hinged portion.

14. The slide top dispensing carton according to claim 13, wherein said rotation assisting means comprises an extension continuous with and extending generally upwardly from the hinged portion of the first side wall, said extension having a free upper edge lying in a plane generally parallel to the plane of the slide panel and an extension base closely adjacent to the foldable connection between the slide panel and hinged portion.

* * * * *